US011479991B2

(12) United States Patent
Hall

(10) Patent No.: US 11,479,991 B2
(45) Date of Patent: Oct. 25, 2022

(54) DOOR LOCK

(71) Applicant: KINGSWAY ENTERPRISES (UK) LIMITED, Swanley (GB)

(72) Inventor: Benjamin Hall, Swanley (GB)

(73) Assignee: Kingsway Enterprises (UK) Limited, Kent (GB)

( * ) Notice: Subject to any disclaimer, the term of this patent is extended or adjusted under 35 U.S.C. 154(b) by 277 days.

(21) Appl. No.: 16/671,374

(22) Filed: Nov. 1, 2019

(65) Prior Publication Data

US 2020/0362594 A1 Nov. 19, 2020

(30) Foreign Application Priority Data

May 17, 2019 (GB) ..... 1907005

(51) Int. Cl.
*E05B 63/18* (2006.01)
*E05B 15/10* (2006.01)
(Continued)

(52) U.S. Cl.
CPC ..... *E05B 63/185* (2013.01); *E05B 15/101* (2013.01); *E05B 15/102* (2013.01); *E05B 63/12* (2013.01); *E05B 65/1013* (2013.01); *E05C 3/124* (2013.01); *E05B 55/12* (2013.01); *E05B 63/08* (2013.01); *E05B 63/127* (2013.01); *E05B 63/20* (2013.01); *E05B 63/205* (2013.01); *E05B 65/0017* (2013.01); *E05B 65/0035* (2013.01);
(Continued)

(58) Field of Classification Search
CPC .. E05B 63/185; E05B 15/101; E05B 65/1013; E05B 3/124; E05B 63/20; E05B 55/12; E05B 63/205; E05B 63/08; E05B 15/102; E05B 63/12; E05B 63/127; E05B 65/0017; E05B 65/0035; E05C 3/124; Y10T 292/0999; Y10T 292/10; Y10T 70/5327
USPC ..... 70/107
See application file for complete search history.

(56) References Cited

U.S. PATENT DOCUMENTS 1,965,809 A * 7/1934 Ross ..... E05C 3/167 292/202
3,582,122 A * 6/1971 Foster ..... E05B 63/20 292/335
(Continued)

FOREIGN PATENT DOCUMENTS

GB 2121469 A 12/1983

OTHER PUBLICATIONS

Great Britain Patent Application No. 1907005.1 Combined Search and Examination Report dated Oct. 22, 2019.

*Primary Examiner* — Christine M Mills
*Assistant Examiner* — Faria F Ahmad
(74) *Attorney, Agent, or Firm* — Erise IP, P.A.

(57) ABSTRACT

The present application provides a lock (100) for a door. The lock comprises a housing (102), a lock mechanism (108), and a bolt (104). An end portion (112) of the bolt comprises a trigger (106). The lock mechanism is operable to move the bolt between a locked position in which the end portion extends through an opening in the housing and projects from the housing, and an unlocked position in which the end portion is within the housing. The lock further comprises a retraction mechanism (110), wherein actuation of trigger causes the retraction mechanism to automatically move the bolt from the locked position into the unlocked position.

20 Claims, 5 Drawing Sheets

(51) Int. Cl.

| | |
|---|---|
| ***E05B 65/10*** | (2006.01) |
| ***E05C 3/12*** | (2006.01) |
| ***E05B 63/20*** | (2006.01) |
| ***E05B 63/08*** | (2006.01) |
| ***E05B 55/12*** | (2006.01) |
| ***E05B 63/12*** | (2006.01) |
| ***E05B 65/00*** | (2006.01) |

(52) U.S. Cl.
CPC ..... *Y10T 70/5327* (2015.04); *Y10T 292/0999* (2015.04); *Y10T 292/10* (2015.04)

(56) References Cited

U.S. PATENT DOCUMENTS 3,921,334 A * 11/1975 Black, Sr. ..... E06B 9/01 292/49
4,946,207 A * 8/1990 Gillham ..... E05B 47/0046 292/144
5,495,731 A * 3/1996 Riznik ..... E05B 63/16 292/39
5,729,198 A * 3/1998 Gorman ..... E05B 63/248 340/539.1
5,896,764 A * 4/1999 Monsch ..... E05C 9/026 70/107
6,046,681 A * 4/2000 Solop ..... E05B 47/026 340/5.26
6,109,666 A * 8/2000 Collet ..... E05B 63/20 292/167
6,318,138 B1 * 11/2001 Mathews ..... E05B 47/0012 292/144
6,381,999 B1 * 5/2002 Doong ..... E05B 47/0012 292/144
6,539,755 B1 * 4/2003 Bruwer ..... E05B 47/0012 292/165
7,353,637 B2 * 4/2008 Harger ..... E05B 15/0086 292/302
7,413,369 B2 * 8/2008 Kienzler ..... F16B 21/125 403/322.1
7,634,928 B2 * 12/2009 Hunt ..... E05B 63/143 70/107
7,775,072 B2 * 8/2010 Pullmann ..... E05B 15/101 70/208
7,836,737 B2 * 11/2010 Lin ..... E05B 65/0858 292/159
2011/0068927 A1 3/2011 Berger
2011/0120024 A1 5/2011 Shifts
2014/0319850 A1 * 10/2014 Berger ..... E05B 15/101 292/177
2018/0320414 A1 * 11/2018 Piantek ..... E05B 63/202

* cited by examiner

DOOR LOCK

RELATED APPLICATION

This application claims priority to Great Britain Patent Application No. 1907005.1, filed May 17, 2019, the disclosure of which is incorporated herein by reference in its entirety.

FIELD

The present disclosure relates to locks for doors, in particular locks for doors in prisons and psychiatric hospitals.

BACKGROUND

Locks for doors are widely used to ensure privacy and security. Broadly speaking, most locks for doors have a housing, a lock mechanism (for example, a keyed lock cylinder or thumb turn), and a bolt. When the lock mechanism is operated (for example, rotated) by a user, it in turn causes the bolt to extend out of the housing into a locked position or to retract into the housing into an unlocked position.

When fitted to a door that has a door leaf and a door frame, a locks as described above enables the door to be locked thus providing privacy and/or security; and unlocked. When locked, the bolt is received by a socket in the door frame, thus substantially preventing movement of the door leaf relative to the door frame.

The primary aim of a lock is to provide security. In order to achieve security, locks are designed to prevent the bolt from moving into the unlocked position (other than by the intended mechanism, e.g. by use of a key). Moreover, locks are designed with redundancies and backup features, all of which are specifically configured to prevent retraction of the bolt into the housing, unless operated by a key.

Inevitably, lockable doors are used in both prisons and psychiatric hospitals, for reasons of security. In many psychiatric hospitals, a lock is usually provided on the inside of each patient's bedroom door, thus also providing privacy to the patients. Indeed, it is illegal for staff to lock psychiatric patients into standard bedrooms without specific dispensation allowing them to do so. Locks are also provided, but for a different reason, as will be understood, on doors of prison cells.

In psychiatric hospitals and prisons, a problem exists that patients may wish to cause themselves harm using a ligature created by securing a rope or cable around an available anchor point in a room. The same problem may arise in facilities other than psychiatric hospitals or prisons, in which locks are provided on doors and people nearby may wish to cause themselves harm.

When a door having a lock as described above is locked, the bolt provides a potential anchor point around which an individual may try to secure a rope or cable (for example phone charger cable) to create a ligature. In particular, an individual may pass a rope or cable between a gap between the door frame and door leaf, and around the bolt. Because the bolt is received in the socket of the door frame, it provides a very stable anchor point. In short, a problem with existing locks is that a ligature can be anchored around the bolt, thus enabling someone to cause themselves harm.

This is particularly problematic, because the ligature may not be visible from the outside of the room, and because it may not be possible to unlock the door by moving the bolt when a weight is suspended from the ligature.

SUMMARY

In a first aspect of the present disclosure, there is provided a lock for a door. The lock comprises a housing, a lock mechanism, and a bolt. An end portion of the bolt comprises a trigger. The lock mechanism is operable to move the bolt between a locked position in which the end portion extends through an opening in the housing and projects from the housing, and an unlocked position in which the end portion is within the housing. The lock further comprising a retraction mechanism, wherein actuation of trigger causes the retraction mechanism to automatically move the bolt from the locked position into the unlocked position.

Accordingly, when a rope or cable is looped around the bolt and pulled, it will actuate the trigger, thus causing the bolt to move into the unlocked position. Thus, the anchor point provided by the bolt when in the locked position is automatically removed when an individual attempts to use the bolt as an anchor point for a ligature.

The trigger may be positioned on the end portion of the bolt, adjacent the opening when the bolt is in the locked position. The trigger may comprise a catch at the end portion of the bolt, for example on the end portion of the bolt, adjacent the opening when the bolt is in the locked position. The catch may have an engaged position in which it protrudes from a side surface of the bolt so as to engage the opening when the bolt is in the locked position; and a disengaged position in which it is substantially flush with the side surface of the bolt; wherein actuation of the trigger comprises moving the catch into the disengaged position. For example, actuation of the trigger may comprise applying a force to the catch to thereby move it into the disengaged position. The catch may engage (for example, 'hook over') an outer surface of the housing when in the engaged position. Further, the catch may protrude slightly from the side of the bolt when in the disengaged position, provided that it is sufficiently recessed from the opening such that the bolt can move to the unlocked position.

The retraction mechanism may resiliently bias the bolt into the unlocked position, such that the bolt automatically moves into the unlocked position upon activation of the trigger. For example, the retraction mechanism may comprise a (first) spring configured to urge the bolt into the unlocked position. A first end of the spring may be coupled with the bolt; and a second end of the spring may be connected to the housing, at a position distal from the opening of the housing.

The catch may be resiliently biased into the engaged position. In particular, the catch may be resiliently biased into the engaged position with a force sufficient to maintain the bolt in the locked position (unless a force is being applied to the catch to thereby move it into the disengaged position). For example, the lock may comprise a spring configured, when the bolt is in the locked position, to urge the catch into the engaged position.

In some examples, the lock may comprise a (single) spring configured to urge the bolt into the unlocked position; and configured, when the bolt is in the locked position, to urge the catch into the engaged position.

The trigger may further comprise an arm, a first end of which is connected to the catch, and a second end of which extends into the housing; the arm being pivotally connected to the bolt. The arm may be pivotally connected to the bolt at a midpoint between the first end and the second ends.

Thus, movement of the catch in a first direction may cause movement of the second end in a second direction, opposite from the first direction. The housing may comprise a bolt guide within which the bolt moves between the locked and unlocked positions, the bolt guide comprising a guide surface configured to prevent the catch from occupying the engaged position when located within the housing.

The lock mechanism may comprise a rotatable paddle; the rotatable paddle contained within the housing and configured, when rotated in a first direction, to move the bolt into the locked position. For example, the paddle may be configured, when rotated in the first direction, to move the bolt into the locked position by pushing against the second end of the arm. The paddle may be further configured, when rotated in the first direction, to move the catch into the engaged position by rotating the arm. The lock mechanism may comprise a thumb turn, or a keyed cylinder lock of the types that are known in the art. The thumb turn or keyed cylinder lock may be configured to cause rotation of the paddle.

Herein, where a first rotational direction and a second rotational direction are referred to, they are to be understood as being opposite rotational directions. In particular, they are to be understood respectively as clockwise and anticlockwise directions; or respectively as anticlockwise and clockwise directions. Similarly, where a rotation and a counter-rotation are referred to, they are to be understood respectively as a clockwise rotation and an anticlockwise rotation; or respectively as an anticlockwise rotation and a clockwise rotation.

The paddle may be configured, when rotated in a second direction, to cause the bolt to move into the unlocked position. For example, the paddle may be configured, when rotated in the second direction, to move the catch into the disengaged position by counter-rotating the arm, thereby causing the bolt to move into the unlocked position.

The trigger may comprise a first catch and a second catch, each of the first catch and the second catch being configured as above. The first catch may be positioned at a first lateral side of the end portion of the bolt, and the second catch may be positioned at a lateral second side of the end portion of the bolt. For example, the trigger may comprise: a first catch on a first lateral side of the end portion of the bolt; and a second catch at on opposing second lateral side of the end portion of the bolt; each catch having an engaged position in which it protrudes from its respective side of the bolt so as to engage the opening when the bolt is in the locked position; and a disengaged position in which it is substantially flush with the respective side of the bolt.

The trigger may further comprise a first arm and a second arm, each of the first and second arms being configured as above. For example, the trigger may comprise: a first arm, a first end of which is connected to the first catch, and a second end of which extends into the housing; the first arm being pivotally connected to the bolt; a second arm, a first end of which is connected to the second catch, and a second end of which extends into the housing; the first arm being pivotally connected to the bolt; and a symmetry linkage coupling the first arm to the second arm, the symmetry linkage configured to ensure mirrored movement of the first and second catches. The retraction mechanism may comprise a spring connected to the symmetry linkage; the spring configured to urge the bolt into the unlocked position, and further configured, when the bolt is in the locked position, to urge the first and second catches into the engaged position. The lock may only comprise a single lock mechanism, and a single rotatable paddle. The rotatable paddle may be configured to interact only with the second end of the first arm.

In other examples, the retraction mechanism may comprise an electromechanical retraction mechanism. For example, the retraction mechanism may comprise an electrical motor configured to move the bolt into the unlocked position upon actuation of the trigger. And the trigger may comprise a pressure sensor, or an optical sensor. For example, the trigger may comprise an infrared optical sensor. The trigger may be configured to send an electrical actuation signal to the retraction mechanism when actuated. The electrical actuation signal may cause the retraction mechanism to retract the bolt. For example, the electrical actuation signal may cause an electrical motor to retract the bolt.

In a second aspect there is provided a door leaf comprising a lock according to the first aspect.

In a third aspect there is provided a door comprising the door leaf of the second aspect and a door frame, the door leaf connected to the door frame by a hinge located at an opposing side of the door leaf from the lock; the door frame comprising a socket for receiving the bolt when the bolt is in the locked position.

BRIEF DESCRIPTION OF THE DRAWINGS

Examples of the present disclosure will now be described, by way of example only, with reference to the accompanying figures, in which.

DETAILED DESCRIPTION

Figure 1:
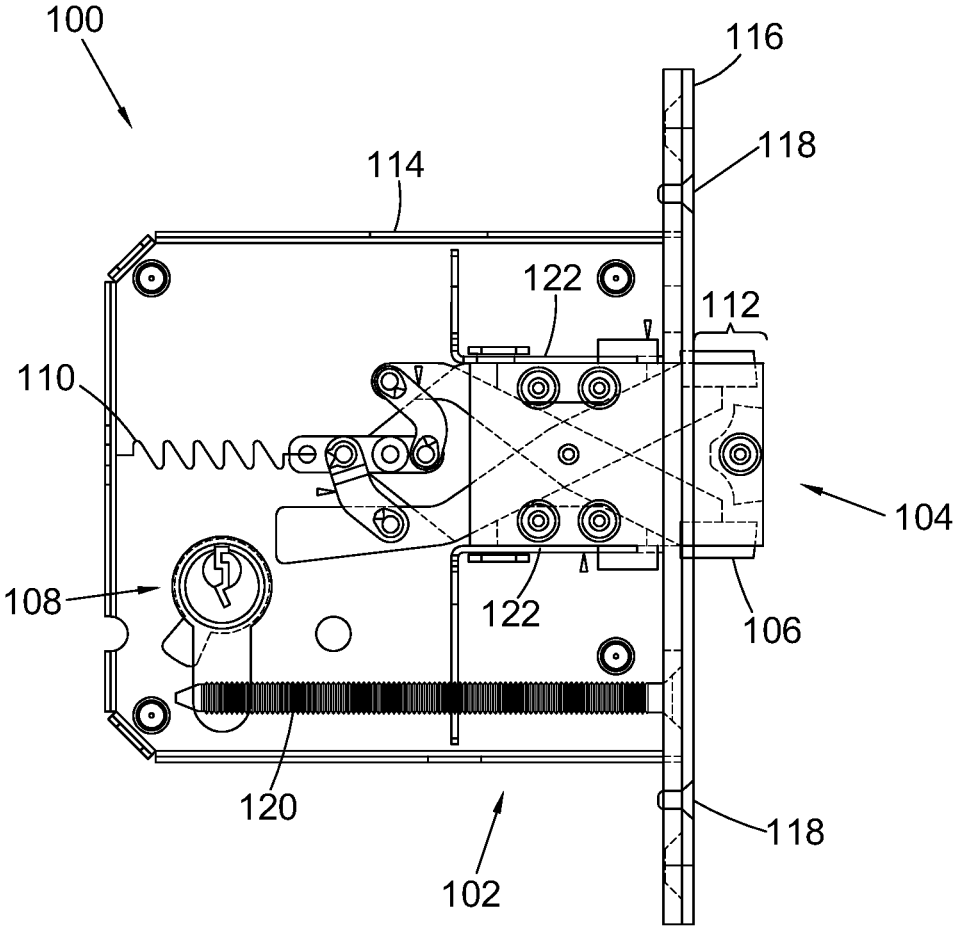
FIG. 1 shows a lock.

FIG. 1 shows a lock 100 according to an example of the present disclosure. The lock 100 comprises a housing 102. The housing contains a bolt 104, trigger 106, lock mechanism 108 and a retraction mechanism (spring) 110. Lock mechanism may be a thumb turn, or may be a keyed cylinder lock actuator. Each of the trigger 106 and the lock mechanism 108 are operable to move the bolt 104 between an unlocked position in which it is concealed within the housing 102, and a locked position in which an end portion 112 of the bolt protrudes through the opening in the housing 102. The spring 110 urges the bolt 104 into the unlocked position, while the trigger prevents the bolt 104 from moving into the unlocked position from the locked position unless activated. FIG. 1 shows the bolt 104 in the locked position. Movement of the bolt between the locked and unlocked positions is described in more detail in FIGS. 4-8.

Housing 102 comprises a base portion 114 configured to sit within, i.e. to be concealed within, a door leaf (not shown); and a front plate 116 configured to sit flush with an edge of the door leaf. The front plate 116 is provided with screws 118 for fixing the lock 100 to a door leaf. Lock mechanism fixing screw 120 holds the lock mechanism 108 in place. A bolt guide 122 is provided within the housing. The bolt guide comprises two guide surfaces, the guide surfaces provided at either side of the bolt 104 so as to guide the bolt as it moves between the locked and unlocked positions.

Figure 2:
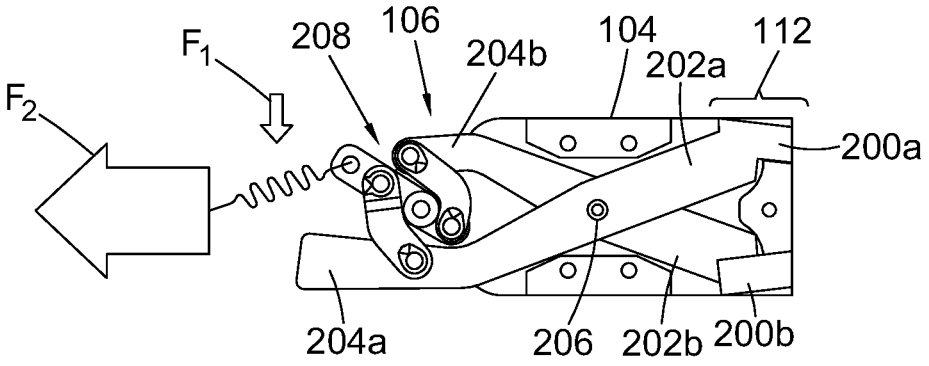
FIG. 2 shows a bolt and trigger from the lock of FIG. 1, with the trigger in a disengaged position.
Figure 3:
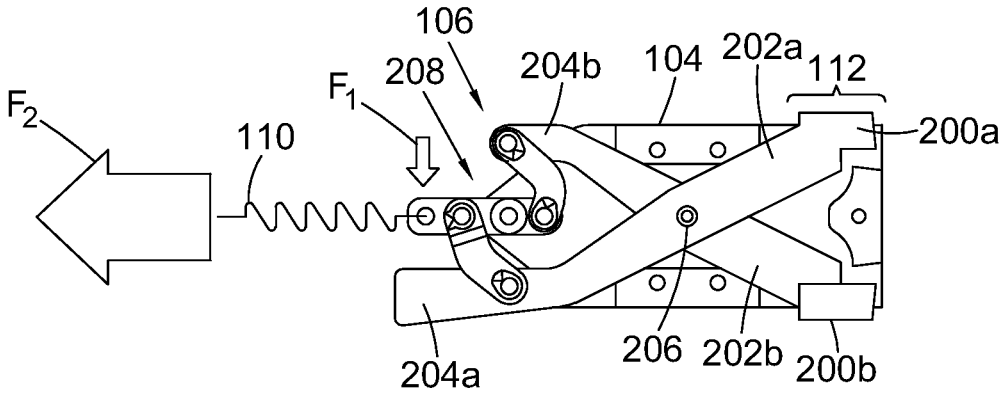
FIG. 3 shows the bolt and trigger of FIG. 2, with the trigger in an engaged position.

FIGS. 2 and 3 show a bolt 104 and trigger 106 of the lock, with reference to FIG. 2. Trigger 106 comprises a first catch 200*a* located at a first side of the end portion 112 of the bolt 104; and a second catch 200*b* located at an opposing side of the end portion 112 of the bolt 104. A first arm 202*a* is connected at a first end thereof to the first catch 200*a*; and a second arm 202*b* is connected at a first end thereof to the second catch 200*b*. The first and second arms extend along the bolt 104 in a direction away from the end portion 112, to a pivot point 206 at which they cross over each other and are rotatably connected to the bolt 104. In effect, the first and second arms 202*a*, 202*b* are pivotally connected to the bolt 104 in a scissor arrangement. The first arm 202*a* and second arm 202*b* each extend past the pivot point 206 and towards an end of the bolt 104 distal from the end portion 112.

The second end 204*a* of the first arm 202*a* is connected to the second end 204*b* of the second arm 202*b* by a symmetry linkage 208. The symmetry linkage couples the first arm 202*a* to the second arm 202*b* in such a way that the arms move as a mirror image of each other. In other words, when the first arm 202*a* rotates in a clockwise direction, the second arm 202*b* matches its movement in a counter-clockwise direction. Accordingly, when the first catch 200*a* moves in an upwards direction, the second catch 200*b* will move an equal distance in a downwards direction, and vice versa.

In FIG. 2, the trigger 106 is shown in an engaged position, in which the catches 200*a*, 200*b* protrude outwards from the sides of the bolt 104. In FIG. 3, the trigger 106 is shown in a disengaged position, in which the catches 200*a*, 200*b* lie substantially flush with the sides of the bolt 104. The disengaged position is accessed by applying a force to one or more of the first and second catches 200*a*, 200*b*.

Connected to the symmetry linkage 208 is a spring 110. Spring 110 is connected to a housing 102 of the lock so as to apply a biasing force (F2) that acts to pull the symmetry linkage 208 (and hence the bolt 104) into the housing. In other words, the spring acts to constantly urge the bolt 104 into the unlocked configuration. Symmetry linkage 208 also applies a biasing force (F1) that acts to urge the catches 200*a*, 200*b* into the engaged position. In other words, the spring acts to constantly urge the catches 200*a*, 200*b* into the engaged position. However, the bolt guide 122 as discussed in respect of FIG. 1 will always act to prevent the catches from entering the engaged position when the bolt 104 is in the unlocked position (i.e. when the catches 200*a*, 200*b* are positioned within the housing). Hence, the trigger 106 can only be moved between the engaged and disengaged positions when the bolt 104 is in the locked position.

As shown in FIGS. 2 and 3, with reference to FIG. 2, the force F2 (as applied by the spring 110) urging the bolt into the unlocked position is largest when the bolt is in the locked position. And the force F1 (as applied by the spring) urging the trigger into the engaged position is largest when the bolt is in the unlocked position.

Operation of the lock will now be described.

Figure 4:
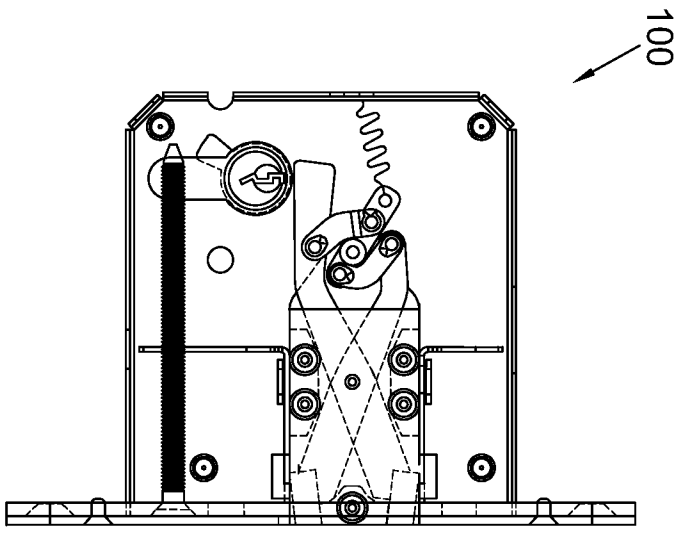
FIG. 4 shows the lock of FIG. 1, with the bolt in an unlocked position.

FIG. 4 shows the lock 100, with the bolt 104 in the unlocked position. In particular, the end portion 112 of the bolt 104 lies flush with the front plate 116, such that the entire bolt 104 is concealed within the housing 102.

Figure 5:
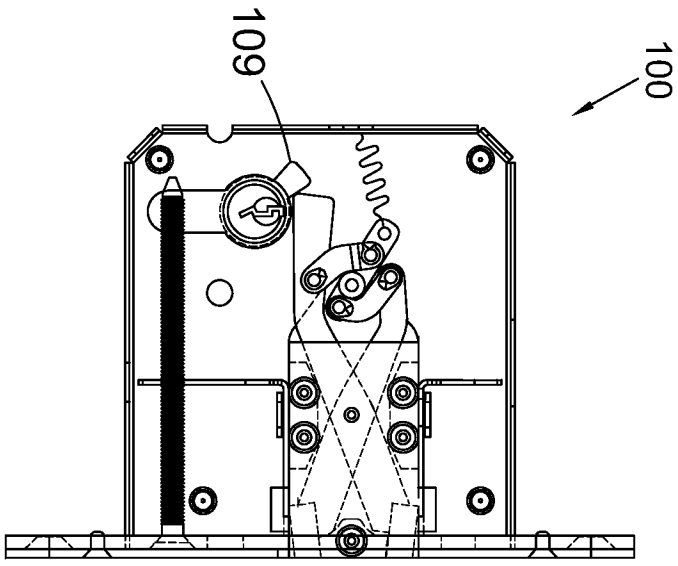
FIG. 5 shows the lock of FIG. 4, with a paddle of the lock mechanism acting to move the bolt into a locked position.

FIG. 5 shows the lock 100, with the bolt 104 still in the unlocked position. A user is operating the lock mechanism 108 so as to rotate a paddle 109 clockwise within the housing until it engages with the second end 204*a* of the first arm 202*a*. By continuing to rotate the paddle 109 in the clockwise direction, the paddle 109 pushes against the second end 204*a* of the first arm 202*a*, and in turn pushes the bolt 104 towards the locked position, against the biasing force of the spring 110. At the same time, the paddle 109 pushes the second end 204*a* of the first arm 202*a* in a slightly downwards direction, thus rotating the first arm in a counter-clockwise direction about the pivot 206, and urging the first catch 200*a* towards the engaged position. Because of the presence of the symmetry linkage 208 the second arm 202*b* is at the same time rotated in a clockwise direction, thus also urging the second catch 200*b* towards the engaged position.

Figure 6:
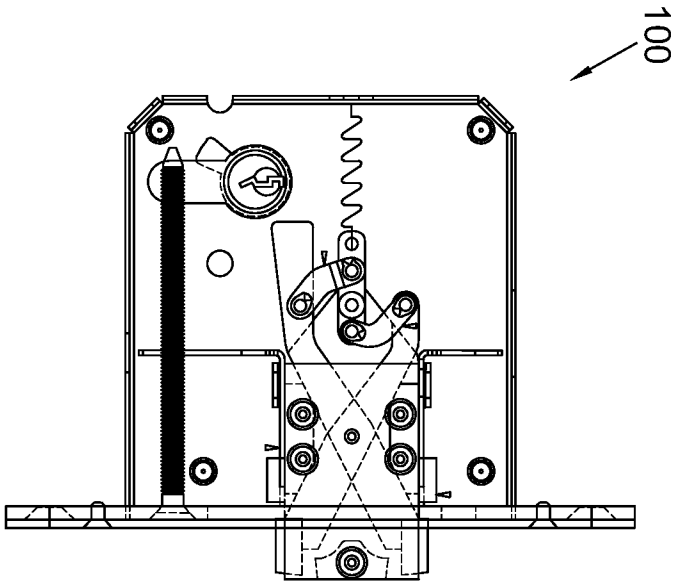
FIG. 6 shows the lock of FIGS. 4 and 5, with the bolt in a locked position.

By fully rotating the paddle 109 in the clockwise direction, the bolt 104 enters the locked position as shown in FIG. 6. In the locked position, the end portion 112 of the bolt 104 protrudes through the opening in the housing 102; and the first and second catches 200*a*, 200*b* are in the engaged position in which they protrude from the side surfaces of the bolt 104, so as to engage an outer edge of the opening in the housing 102. Thus, the catches act to maintain the bolt 104 in the locked position, against the biasing force of the spring 110.

Figure 7:
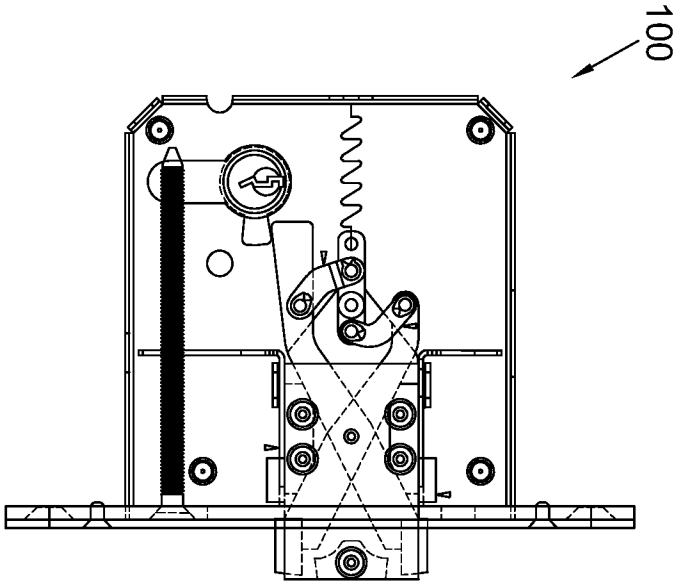
FIG. 7 shows the lock of FIGS. 4-6, with the paddle of the lock mechanism acting to move the bolt into the unlocked position.
Figure 8:
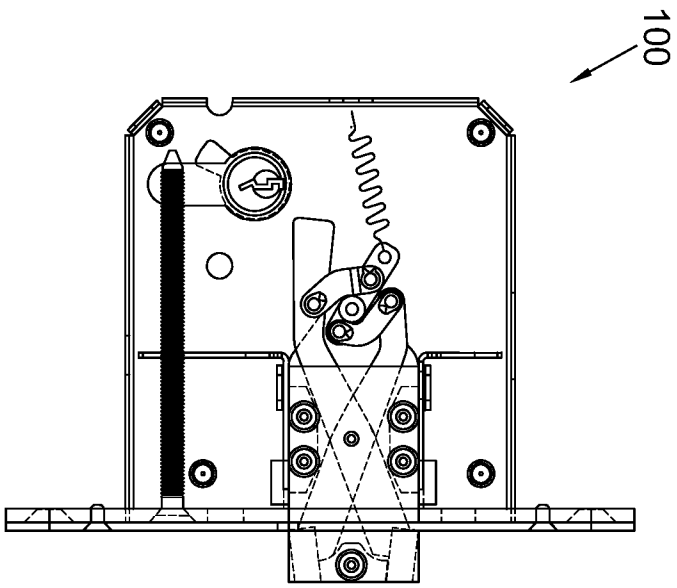
FIG. 8 shows the lock of FIGS. 4-7, with the trigger activated so as to cause the lock to move into the unlocked position.

If a user wishes to unlock the lock, they again operate the lock mechanism so as to rotate the paddle 109 in an anti-clockwise direction. As shown in FIG. 7, after some rotation, the paddle 109 will contact an underside of the second end 204*a* of the first arm 202*a*. By continuing to move the paddle 109 in the anti-clockwise direction, it pushes upwards on the underside of the second end 204*a* of the first arm 202*a*, thereby rotating the first arm 202*a* in the clockwise direction and thus pushing the first catch 200*a* into the disengaged position. Because of the presence of the symmetry linkage 208 the second arm 202*b* is at the same time rotated in the anti-clockwise direction, thus also urging the second catch 200*b* towards the disengaged position. In short, the catches 200*a*, 200*b* are caused to move so that they lie substantially flush with the sides of the bolt 104, and so that they therefore no longer engage the opening. Therefore, with nothing maintaining the bolt 104 in the locked position, the spring 110 causes the bolt 104 to move into the unlocked position.

Alternatively, if someone attempts to loop a string, rope, wire or cable around the end portion 112 of the bolt 104 while the lock 100 is in the locked position as shown in FIG. 6, the string, rope, wire or cable will apply a force to one or both of the first catch 200*a* and the second catch 200*b*. This in turn will depress the catch(s) to which the force is applied. Both catches will be depressed because of the presence of the symmetry linkage 208. In short, the string, rope, wire or cable will cause the catches to move into the disengaged position, in which they no longer engage the opening. Therefore, with nothing maintaining the bolt 104 in the locked position, the spring causes the bolt to move into the unlocked position, with the bolt substantially concealed by the housing 102 of the lock 100. Therefore, the end portion of the bolt (which was previously being used as an anchor point for the string, rope, wire or cable) no longer protrudes so as to provide an anchor point. In short, the trigger (catches) prevent the bolt from being used as an anchor from which to secure a ligature.

It is to be understood that the above description is intended to be illustrative, and not restrictive. Many other implementations will be apparent to those of skill in the art upon reading and understanding the above description. For example, the embodiment described in the specific description is a purely mechanical embodiment. However, as the skilled person will realise (and as is disclosed in the summary section), the lock disclosed herein can also be an electromechanical lock. For example, the retraction mechanism could be an electrical motor, and the trigger could be an electrical pressure sensor, or an optical sensor. Also, where a direction is used herein, it is to be understood that the direction could be reversed. For example, where a 'clockwise' and 'anticlockwise' direction are referred to, it is to be understood that these directions could be reversed. Although the present disclosure has been described with reference to a specific example implementation, it will be recognized that the disclosure is not limited to the implementations described, but can be practiced with modification and alteration insofar as such modification(s) and alteration(s) remain within the scope of the appended claims. Accordingly, the specification and drawings are to be regarded in an illustrative sense rather than a restrictive sense. The scope of the disclosure should, therefore, be determined with reference to the appended claims, along with the full scope of equivalents to which such claims are entitled.

The invention claimed is:

1. A lock for a door, the lock comprising:

a housing, a lock mechanism, and a bolt;

the lock mechanism operable to move the bolt between a locked position in which an end portion of the bolt extends through an opening in the housing and projects from the housing, and an unlocked position in which the end portion is within the housing, wherein the bolt comprises a trigger located at the end portion of the bolt that extends through the opening in the housing, wherein a portion of the trigger extends out of the housing; and the lock further comprising a retraction mechanism, wherein actuation of the trigger causes the retraction mechanism to automatically move the bolt from the locked position into the unlocked position.

2. The lock of claim 1, wherein the trigger comprises a catch at the end portion of the bolt, the catch having an engaged position in which it protrudes from a side surface of the bolt so as to engage the opening when the bolt is in the locked position, and a disengaged position in which it is depressed towards the side surface of the bolt, wherein actuation of the trigger comprises moving the catch into the disengaged position.

3. The lock of claim 1, wherein the retraction mechanism resiliently biases the bolt into the unlocked position.

4. The lock of claim 2, wherein the catch is resiliently biased into the engaged position.

5. The lock of claim 2, wherein the trigger further comprises an arm, a first end of which is connected to the catch, and a second end of which extends into the housing, the arm being pivotally connected to the bolt.

6. The lock of claim 2, wherein the lock mechanism comprises a rotatable paddle, the rotatable paddle contained within the housing and configured, when rotated in a first direction, to move the bolt into the locked position.

7. The lock of claim 6, wherein the paddle is configured, when rotated in a second direction opposite to the first direction, to cause the bolt to move into the unlocked position.

8. The lock of claim 7, wherein the paddle is configured, when rotated in the second direction, to move the catch into the disengaged position by counter-rotating an arm, thereby causing the bolt to move into the unlocked position.

9. The lock of claim 6, wherein the paddle is configured, when rotated in the first direction, to move the bolt into the locked position by pushing against a second end of an arm.

10. The lock of claim 9, wherein the paddle is further configured, when rotated in the first direction, to move the catch into the engaged position by rotating the arm.

11. The lock of claim 2, further comprising a bolt guide within which the bolt moves between the locked and unlocked positions, the bolt guide comprising a guide surface configured to prevent the catch from entering the engaged position when located within the housing.

12. The lock of claim 1, wherein the trigger comprises:

a first catch on a first side of the end portion of the bolt; and a second catch on an opposing second side of the end portion of the bolt;

each catch having an engaged position in which it protrudes from its respective side of the bolt so as to engage the opening when the bolt is in the locked position, and a disengaged position in which it is substantially flush with the respective side of the bolt.

13. The lock of claim 12, wherein the trigger further comprises:

a first arm, a first end of which is connected to the first catch, and a second end of which extends into the housing, the first arm being pivotally connected to the bolt;

a second arm, a first end of which is connected to the second catch, and a second end of which extends into the housing, the second arm being pivotally connected to the bolt; and a symmetry linkage coupling the first arm to the second arm, the symmetry linkage configured to ensure mirrored movement of the first and second catches.

14. The lock of claim 13, wherein the retraction mechanism comprises a spring connected to the symmetry linkage, the spring configured to urge the bolt into the unlocked position, and further configured, when the bolt is in the locked position, to urge the first and second catches into the engaged position.

15. A door leaf comprising:

a lock for a door, the door including the door leaf;

the lock comprising:

a housing, a lock mechanism, and a bolt;

the lock mechanism operable to move the bolt between a locked position in which an end portion of the bolt extends through an opening in the housing and projects from the housing, and an unlocked position in which the end portion is within the housing, wherein the bolt comprises a trigger located at the end portion of the bolt that extends through the opening in the housing, wherein a portion of the trigger extends out of the housing; and the lock further comprising a retraction mechanism, wherein actuation of the trigger causes the retraction mechanism to automatically move the bolt from the locked position into the unlocked position.

16. A door comprising:

a door frame;

a door leaf connected to the door frame by a hinge located at an opposing side of the door leaf from a lock;

the lock comprising:

a housing, a lock mechanism, and a bolt;

the lock mechanism operable to move the bolt between a locked position in which an end portion of the bolt extends through an opening in the housing and projects from the housing, and an unlocked position in which the end portion is within the housing, wherein the bolt comprises a trigger located at the end portion of the bolt that extends through the opening in the housing, wherein a portion of the trigger extends out of the housing;

the lock further comprising a retraction mechanism, wherein actuation of the trigger causes the retraction mechanism to automatically move the bolt from the locked position into the unlocked position; and the door frame further comprising a socket for receiving the bolt when the bolt is in the locked position.

17. The door of claim 16, wherein the trigger comprises a catch at the end portion of the bolt, the catch having an engaged position in which it protrudes from a side surface of the bolt so as to engage the opening when the bolt is in the locked position, and a disengaged position in which it is depressed towards the side surface of the bolt, wherein actuation of the trigger comprises moving the catch into the disengaged position.

18. The door of claim 17, wherein the trigger further comprises an arm, a first end of which is connected to the catch, and a second end of which extends into the housing, the arm being pivotally connected to the bolt.

19. The door of claim 17, wherein the lock mechanism comprises a rotatable paddle, the rotatable paddle contained within the housing and configured, when rotated in a first direction, to move the bolt into the locked position.

20. The door of claim 16, wherein the trigger comprises:

a first catch on a first side of the end portion of the bolt; and a second catch on an opposing second side of the end portion of the bolt;

each catch having an engaged position in which it protrudes from its respective side of the bolt so as to engage the opening when the bolt is in the locked position, and a disengaged position in which it is substantially flush with the respective side of the bolt.

* * * * *